US005934627A

United States Patent [19]

Lewis et al.

[11] Patent Number: 5,934,627

[45] Date of Patent: Aug. 10, 1999

[54] TANK SUPPORT APPARATUS

[76] Inventors: Ronald A. Lewis, P.O. Box 38, Terrace, British Columbia, Canada, V8G 4R2; Samuel J. Menzies, 19352-60th Avenue, Surrey British Columbia, Canada, V3S 8E5

[21] Appl. No.: 08/917,125

[22] Filed: Aug. 25, 1997

[51] Int. Cl.[6] ..... A47G 23/02

[52] U.S. Cl. ..... 248/148; 248/188.4; 248/237; 248/371; 248/346.05

[58] Field of Search ..... 248/133, 148, 248/154, 188.4, 237, 346.05, 371, 397, 398; 108/7

[56] References Cited

U.S. PATENT DOCUMENTS

| | | | |
|---|---|---|---|
| 180,806 | 8/1876 | Striegel | 248/397 |
| 330,546 | 11/1885 | Barlow | 248/237 |
| 354,703 | 12/1886 | Huestis . | |
| 1,543,531 | 6/1925 | Streisel | 248/154 |
| 2,513,461 | 7/1950 | Duncan, Jr. | 248/156 X |
| 2,750,139 | 6/1956 | Young | 248/148 |
| 3,017,152 | 1/1962 | Alpaugh | 248/148 |
| 4,450,935 | 5/1984 | Gustavus | 248/237 X |
| 4,576,352 | 3/1986 | Ogden | 248/188.4 |
| 4,695,023 | 9/1987 | McCafferty | 248/237 X |
| 4,856,745 | 8/1989 | Mabie | 248/237 |
| 4,917,345 | 4/1990 | Czech | 248/237 X |
| 4,962,906 | 10/1990 | Fatool et al. | 248/148 |
| 5,249,397 | 10/1993 | Monaco . | |
| 5,318,148 | 6/1994 | Franco et al. . | |

*Primary Examiner*—Derek J. Berger
*Attorney, Agent, or Firm*—Lance A. Turlock

[57] ABSTRACT

An apparatus for holding an elongated tank such as a propane tank in an upright position when the apparatus is positioned on an inclined surface is disclosed. The apparatus includes a base support to provide a footing for the apparatus on the surface, a tank support for carrying the tank. The tank is secured to the tank support with the longitudinal axis of the tank extending substantially perpendicular to a plane of support associated with the tank support. Further, the tank support is pivotally connected to the base support to permit pivotal movement of the tank support relative to the base support about a pivot axis extending parallel to the plane of support, and is pivotable about the pivot axis between a position where the plane of support extends substantially parallel to the inclined surface and a braced position where the plane of support extends substantially horizontally.

5 Claims, 6 Drawing Sheets

TANK SUPPORT APPARATUS

FIELD OF THE INVENTION

The present invention relates to apparatus for holding an elongated tank in a stable, upright position on a sloped or inclined surface. It is considered particularly suitable for, but not limited to, securing propane fuel tanks in such a position.

BACKGROUND TO THE INVENTION

In various situations where propane is used for fuel heating or other purposes, the need to secure and stabilize a propane tank (sometimes referred to as a propane bottle) in an upright position can be problematic. The larger ones of such tanks are typically configured as elongated cylinders where, in use, operating and safety considerations dictate that they be held in a substantially upright position with fuel being drawn from a top end of the cylinder. But, the upright position is inherently unstable and suitable measures should be taken to ensure that the tank is not tilted and is properly secured in the required position.

The problem becomes aggravated if the surface at the location where one wishes to position the tank is a sloped or inclined surface. Of course, one solution is to custom build a support structure for the specific location. But, this approach has limitations. The process of designing and building the structure may add a significant amount to the time required to instal the tank. Personnel may not be readily available to do the necessary work. Or, the materials and tools required to build a suitable support structure may not be readily at hand. Or, the work may be done in an unsatisfactory manner thereby creating a safety hazard. Further, a support structure which is suitable for one location may not be suitable for another. It may lack portability and, once installed at one working site, may be difficult to disassemble for transportation, reassembly and use at another site.

The prior art reveals a variety of platform or scaffold-type devices for carrying various objects in a horizontal plane on an inclined surface, and which are adjustable to accommodate different surface slopes. An early example is disclosed in U.S. Pat. No. 354,703 granted to Huestis on Dec. 21, 1886. A more recent example is disclosed in U.S. Pat. No. 5,318,148 granted to Franco et al. on Jun. 7, 1994. However, while the devices disclosed are suitable for carrying some objects, they are not suitable for carrying an elongated tank such as a propane tank in a secure and stable upright position. Further, while the devices disclosed are adjustable to accommodate different inclines, the mechanisms for adjustment are not well suited to permit a smooth continuous adjustment, particularly while carrying a heavy object such as a propane tank.

Accordingly, a primary object of the present invention is to provide a new and improved apparatus for holding an elongated tank such as a propane tank in a secure and stable upright position on an inclined surface.

A further object of the present invention is to provide a new and improved apparatus of the foregoing type which can be easily adjusted to accommodate different surface inclines.

Yet another object of the present invention is to provide a new and improved apparatus of the foregoing type which is simple to instal and use, and which is simple to remove and transport from one working site to another.

SUMMARY OF THE INVENTION

In accordance with a broad aspect of the present invention, there is provided an apparatus for holding an elongated tank such as a propane tank in an upright position when the apparatus is positioned on an inclined surface. The apparatus includes a base support means to provide a footing for the apparatus on the surface, a tank support means for carrying the tank, and a means for securing the tank to the tank support means with the longitudinal axis of the tank extending substantially perpendicular to a plane of support associated with the tank support means. Further, the apparatus includes a means for pivotally connecting the tank support means to the base support means for permitting pivotal movement of the tank support means relative to the base support means about a pivot axis extending parallel to the plane of support, a means for pivoting the tank support means about the pivot axis between a position where the plane of support extends substantially parallel to the inclined surface and a position where the plane of support extends substantially horizontally, and a means for bracing the tank support means in the horizontal position.

In a preferred embodiment, the base support means comprises a framework and the tank support means comprises a platform pivotally mounted to the framework. The bottom end of the tank is rested on the platform.

Advantageously, the means for securing the tank to the platform comprises a plurality of anchor lines, each of the anchor lines being securable at one end to the platform and, at an opposed end, at or near the top end of the tank, preferably to a collar removably positionable over and against the top end of the tank. With suitable anchor lines, for example lines formed from chain, the tank may be stably secured to the platform. Preferably, such lines include turnbuckles to permit the lines to be strongly tensioned thereby enhancing rigidity when the tank is secured. As well, turnbuckles will permit the anchor lines to be easily relaxed for the purpose of removing the tank from platform.

In a preferred embodiment, the means for pivoting the platform comprises a crank, the crank including a crank shaft threadingly engaged with the platform and a crank handle for rotating the shaft. A crank shaft support carried by the framework rotatably holds a base end of the shaft and permits rotation of the base end in the support during rotation of the shaft using the crank handle. Such cranking means permits a smooth continuous adjustment of the pivot angle between the framework and the platform and, accordingly, the angle of the platform plane of support relative to the surface on which the framework is located. Further, since a significant mechanical advantage can be achieved with such cranking means, a user can make such adjustments with relative ease while a tank is on the platform and despite the fact that the weight of the tank may be considerable.

The foregoing and other features and advantages of the present invention will now be described with reference to the drawings.

DETAILED DESCRIPTION OF PREFERRED EMBODIMENT

Figure 1:
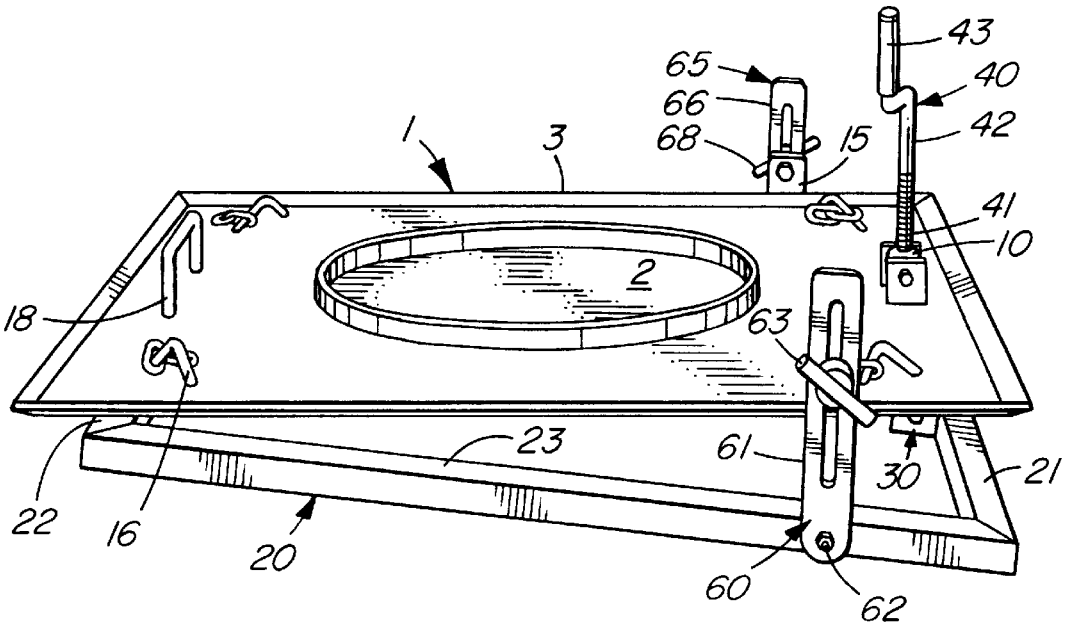
FIG. 1 is a side view of a tank holding apparatus in accordance with the present invention.
Figure 2:
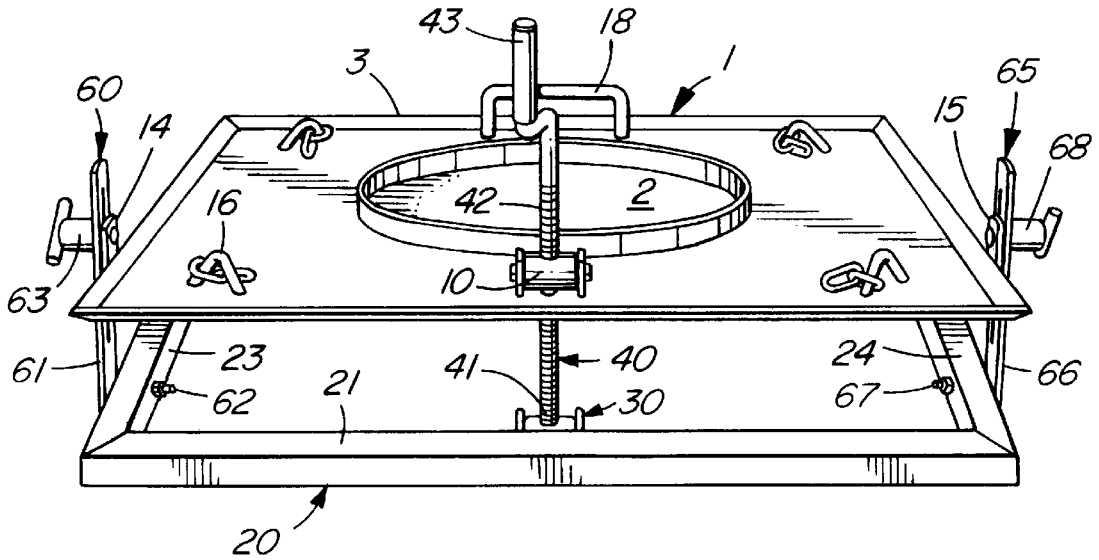
FIG. 2 is a front view of the apparatus shown in FIG. 1.

The tank holding apparatus shown in the figures is particularly adapted for the holding of propane tanks (or bottles) and includes a tank support means or platform generally designated 1 pivotally connected to a base support means or framework generally designated 20. In FIGS. 1 and 2, framework 20 is depicted with a downward angle as would be the case if the apparatus was positioned on an inclined surface. Platform 1 has been rotated upwardly from the framework to a generally horizontal position that would be used if the apparatus was holding a tank.

Figure 3:
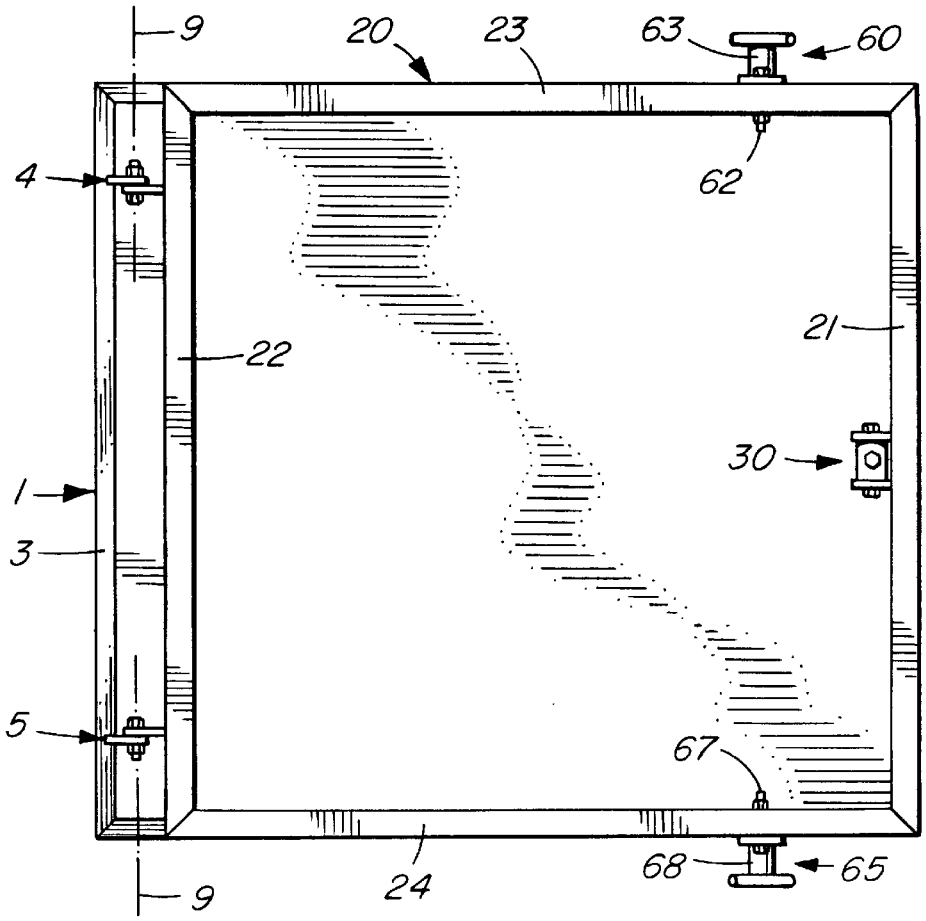
FIG. 3 is a bottom view of the apparatus shown in FIG. 1.

Platform 1 presents a flat upper surface 2 and is formed from aluminum sheet material bent upwardly around perimeter 3 to lessen the flexibility of the sheet. As best seen in FIG. 3, framework 20 has an overall rectangular configuration formed from a front 21, rear 22 and opposed connecting sides 23, 24, of rectangular aluminum tubing, and serves to provide a footing for the apparatus on a desired surface.

As described below in more detail, a propane tank such as propane tank 100 shown in FIG. 4, or such as propane tank 200 shown in FIG. 5, (neither of which are to be considered as part of the invention) normally will be carried on platform 1 with bottom end 101 or 201 of the particular tank, as the case may be, rested on upper surface 2 of the platform. Accordingly, surface 2 may be considered to offer a plane of support associated with the platform.

Figure 6:
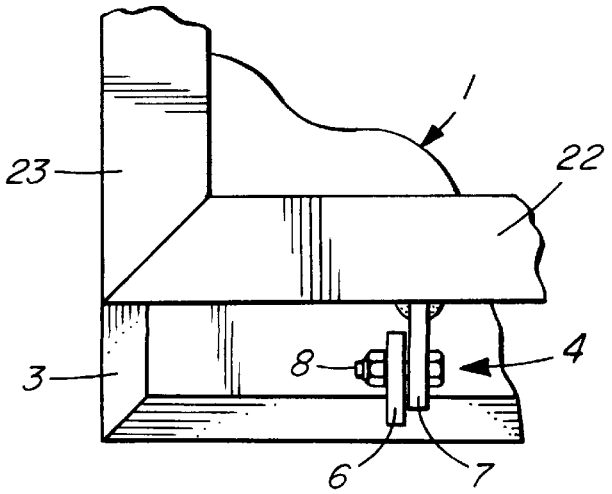
FIG. 6 illustrates one of the hinge connections between the framework and platform portions of the apparatus shown in FIG. 1.

As best seen in FIG. 3, platform 1 is pivotally connected to rear side 22 of framework 20 by a pair of hinge connections generally designated 4, 5 which permit pivotal movement of platform 1 relative to framework 20 about a pivot axis 9 extending through connections 4, 5 and parallel to the plane of support offered by surface 2. As shown in enlarged detail in FIG. 6, hinge connection 4 includes a flange 6 extending downwardly from platform 1 and a flange 7 extending rearwardly from rear side 22. The two flanges 6, 7 are coupled by a hinge bolt 8. Hinge connection 5 is a mirror image of hinge connection 4.

Figure 8:
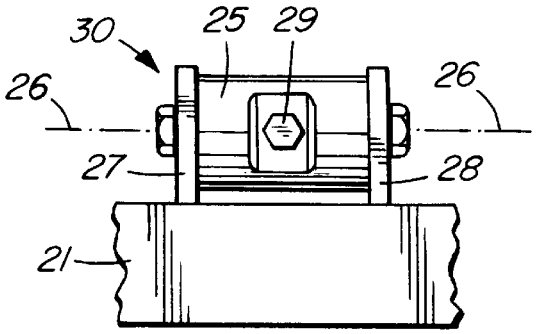
FIG. 8 is a bottom view a crank shaft support forming part of the crank shaft mechanism show in FIG. 7.
Figure 7:
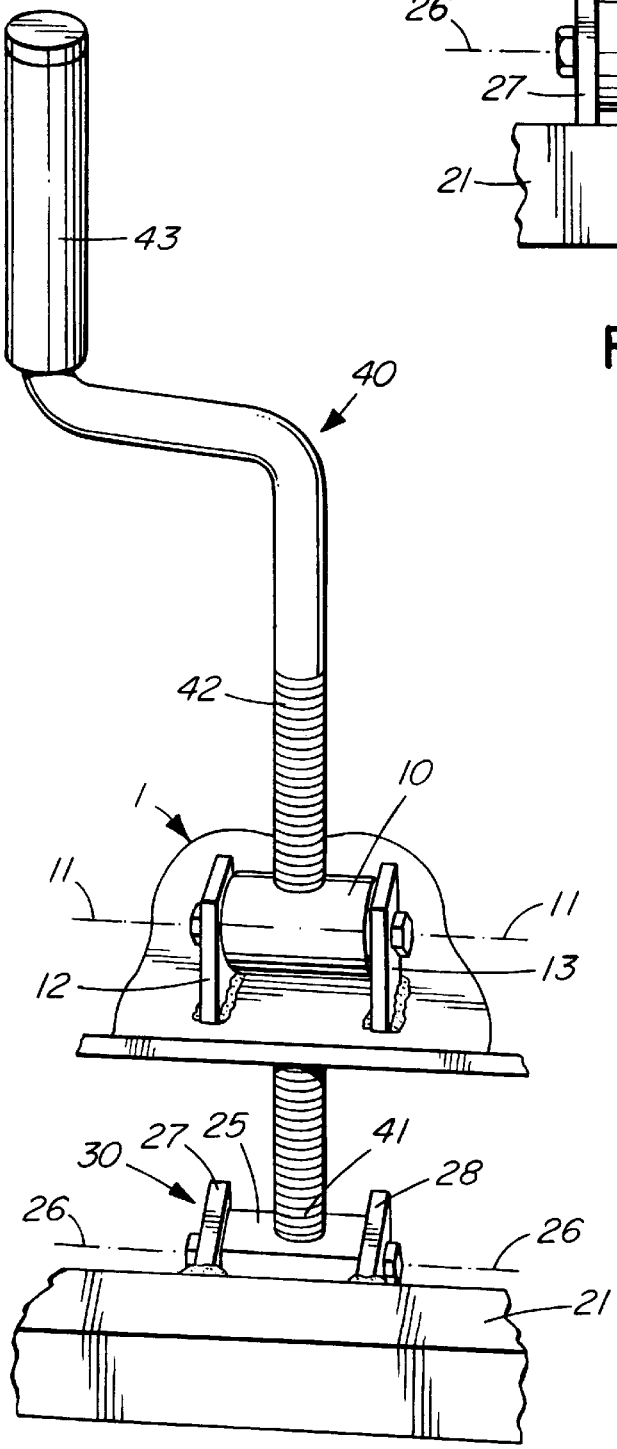
FIG. 7 illustrates in more detail the crank shaft mechanism forming part of the apparatus shown in FIG. 1.

The apparatus shown in the figures further includes means for pivoting platform 1 relative to framework 20 about pivot axis 9. More particularly, and as best seen in FIG. 2, the apparatus includes a crank generally designated 40 comprising a crank shaft 42 extending upwardly from a base end 41 to a crank handle 43 at its top end. As shown in more detail in FIG. 7, shaft 42 is threadingly engaged with platform 1 through threaded engagement with a collar 10, the latter of which is mounted for rotation about horizontal axis 11 between a pair of flanges 12, 13 which extend upwardly from platform 1. As shown in more detail in FIG. 8, base end 41 of shaft 42 is rotatably held by a crank shaft support generally designated 30. Support 30 includes a collar 25 which is mounted for rotation about horizontal axis 26 between a pair of flanges 27, 28 which extend inwardly from front side 21 of framework 20. Base end 41 is secured in collar 25 with a socket head cap screw 29 which extends into and rotates with shaft 42 when the shaft is cranked, but which may be removed by unscrewing while the shaft is immobile. When screw 29 is removed, it will be appreciated that crank 40 may be separated from the remainder of the apparatus simply by turning the crank until shaft 42 has fully threaded upwardly through collar 10.

In addition to serving as a means for pivoting platform 1 about pivot axis 9, crank 40 also serves as a means for bracing the platform in the position to which it is pivoted. In to other words, once platform 1 is pivoted to a specific position by the operation of crank 40, it will be held in that position by the crank. In effect, the positioning of platform 1 relative to framework 20 is then braced or stabilized at three points: firstly and secondly by hinge connections 4, 5 which may be considered to define the base of a bracing triangle, and thirdly by shaft 40 which may be considered to define the apex of the bracing triangle. However, depending upon the size and weight of the propane tank carried by platform 1, it may be found that the front of platform 1 is unacceptably wobbly or susceptible to extraneous loads acting outside the area of the bracing triangle. Accordingly, in order to more securely brace platform 1 in a desired position, the bracing means used in the embodiment shown in the figures further includes a pair of adjustable length bracing 20 members generally designated 60, 65. Bracing member 60 extends from side 23 of framework 20 to a corresponding side of platform 1. Bracing member 65 extends similarly from opposed side 24 of framework 20 to a corresponding side of platform 1. Both bracing members 60, 65 are located towards the front of platform 1 and relatively near front side 21 of framework 20. Bracing member 60 includes a slotted bar 61 pivotally connected by a bolt 62 to side 23 framework 20, and a related clamping mechanism 63 for releasably tightening bar 61 at a desired location against flange 14 extending upwardly from a side of platform 1. Bracing member 65 includes a similar slotted bar 66 pivotally connected by a similar bolt 67 to side 24 of framework 20, and a similar clamping mechanism 68 for releasably tightening bar 66 against flange 15 extending upwardly from the opposite side of platform 1. When clamping mechanisms 63, 68 are tightened, the positioning of platform 1 relative to framework 20 is further braced at the clamping points.

The apparatus shown in the figures further includes means for securing a propane tank to platform 1 with the longitudinal axis of the tank extending substantially perpendicular to the plane of support offered by surface 2 of platform 1. More particularly, and now referring to FIG. 4, propane tank 100 shown in that figure is secured to platform 1 by means of four anchor lines generally designated 80 (only three of which are visible). When full with fuel, tank 100 may weigh upwardly of 200 pounds.

Figure 9:
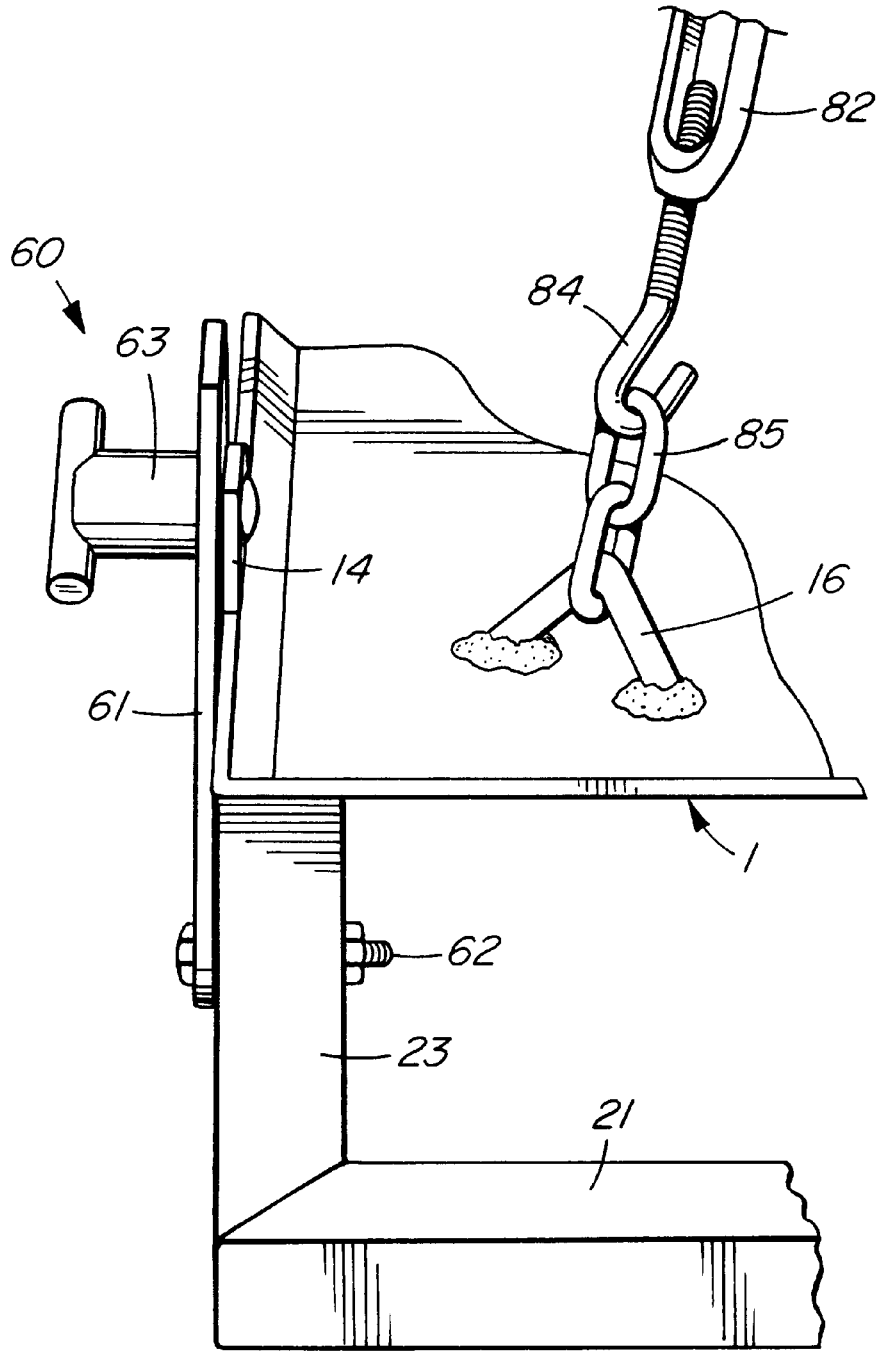
FIG. 9 illustrates in more detail one of the brace member connections between the framework and platform portions of the apparatus shown in FIG. 1.

Each anchor line 80 includes a length of chain 81 and a turnbuckle 82. Each turnbuckle 82 includes hooks 83, 84 at its upper and lower ends respectively. Each hook 83 is selectively hooked through a desired link in its corresponding chain 81. As best seen in FIG. 9, each hook 84 is hooked through a link of a short two link chain segment 85, the other one of which links is slidably held by a loop bracket 16 welded to surface 2 of platform 1. Each anchor line 80 is thereby secured at its lower end to platform 1.

The opposed top ends of each anchor line 80 are interlinked at equal spaced intervals with a chain loop or collar 86 positioned over and against top end 102 of tank 100. Of course, the size of the loop is necessarily less than the diameter of tank 100. Then, as turnbuckles 82 are tightened, collar 86 draws down rigidly against the top end 102 thereby securing anchor lines 80 near the top end. Concurrently, tank 100 is drawn against and rigidly secured to platform 1 with its longitudinal axis 103 extending perpendicular to the plane of support offered by platform surface 2 to bottom end 101 of the tank.

Platform 1 includes a circular sleeve 17 which extends upwardly from surface 2 and which is sized to slidingly receive bottom end 101 of tank 100. As such, it can serve to better secure the tank against unwanted lateral movement or slippage on surface 2. However, sleeve 17 is not considered essential. In this regard, it will noted from FIG. 5 that bottom end 201 of smaller tank 200 is configured somewhat differently than bottom end 101 of tank 100. Further, the diameter of bottom end 201 of tank 200 is considerably less than that of sleeve 17. Thus, sleeve 17 does not assist to secure tank 200 against lateral movement and at best might be used to center tank 200 when it is being positioned on platform 1. However, using anchor lines 180 and a chain loop or collar 186 similar to anchor lines 80 and collar 86 used to secure tank 100, it was found that tank 200 was secured more than adequately on platform 1.

Platform 1 also includes a handle 18, the purpose of which is to assist lifting the apparatus or dragging the apparatus across a surface.

In use, the basic purpose of the apparatus shown in the figures is of course to hold an elongated tank such as tank 100 or tank 200 in an upright position when the apparatus is positioned on an inclined surface. Thus, in FIGS. 4 and 5, the apparatus is shown by way of example positioned on a roof surface 300 having a slope or incline of about 1:12.

The apparatus is first positioned on roof surface 300 with framework 20 providing a footing on the surface. Front and rear sides 21, 22 of the framework run horizontally with respect to the surface while connecting sides 23, 24 extending upwardly from front to rear towards the top of the roof. Then, using crank 40 and with clamping mechanisms 63, 68 released, platform 1 is pivoted relative to framework 20 until the plane of support offered by surface 2 extends in a horizontal plane. This adjustment may be made quite precisely with the aid of a carpenter's level (not shown) placed on surface 2. Further, it may be made with or without tank 100 or tank 200, as the case may be, already secured to platform 1 in the manner described above. When the adjustment is complete, clamping mechanisms 63 and 68 are tightened.

When tank 100 or tank 200, as the case may be, is secured to platform 1 in the manner described above, the longitudinal axis 103 or 203 of the tank, as the case may be, will extend substantially perpendicular to the plane of support offered by platform surface 2. It follows that axis 103 or 203, as the case may be, will extend substantially vertically when surface 2 is adjusted to a substantially horizontal position. The tank is thereby secured in an upright position and is ready for use when a fuel line (not shown) is connected to the top end of the tank in the usual manner.

Once the apparatus has been installed in a desired position and a tank secured, the replacement of the tank is simply a matter of releasing anchor lines 80 to permit removal of the existing tank and positioning of the replacement tank. Anchor lines 80 are then engaged with the replacement tank, including adjustments to the effective length of the lines in the event that one tank is taller than the other. (In the event that the diameter of one tank is significantly different from that of the other, then it may also be necessary to adjust the size of collar 86).

Figure 4:
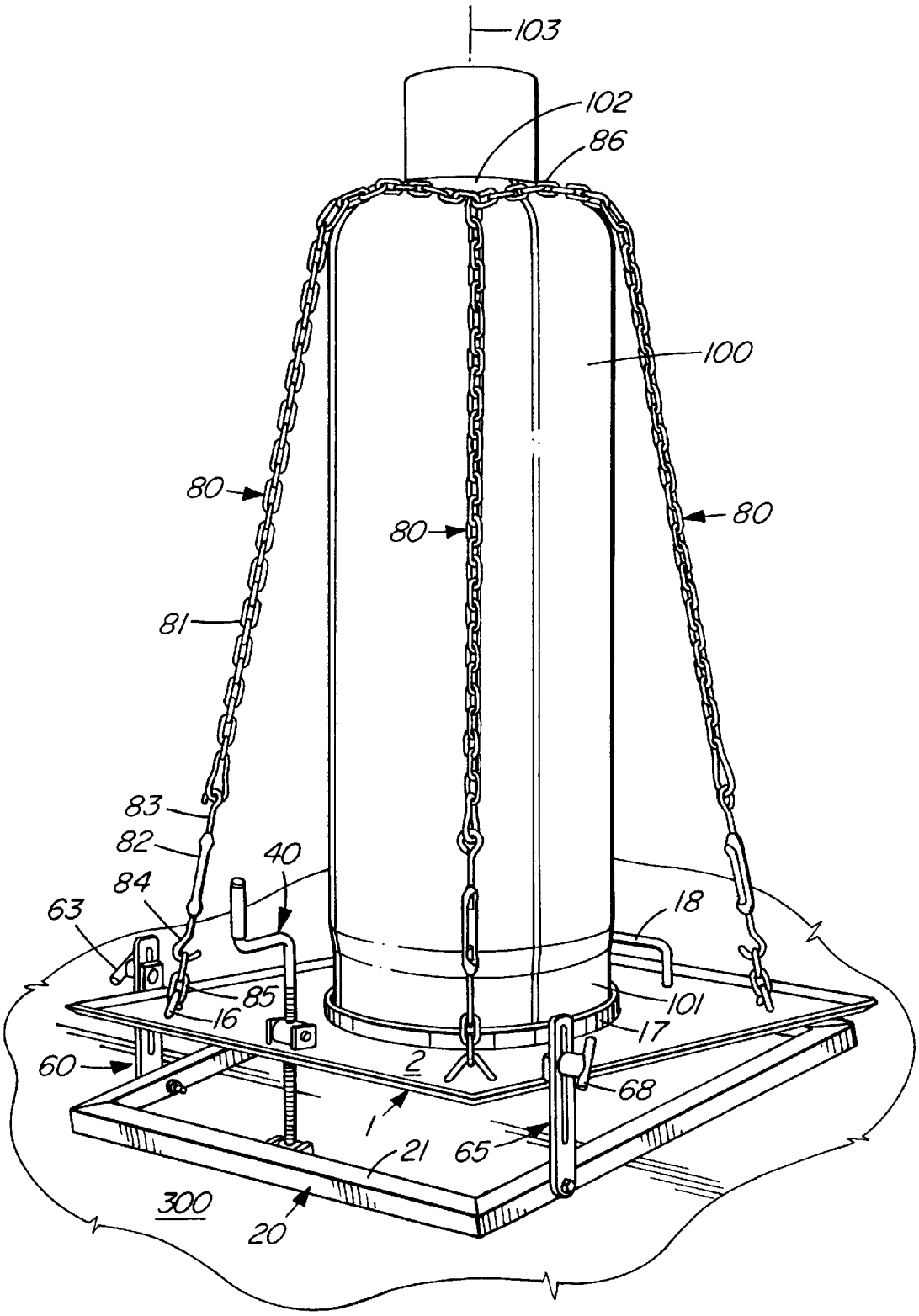
FIG. 4 illustrates the apparatus shown in FIG. 1 while carrying a relatively large propane tank in upright position on an inclined surface.
Figure 5:
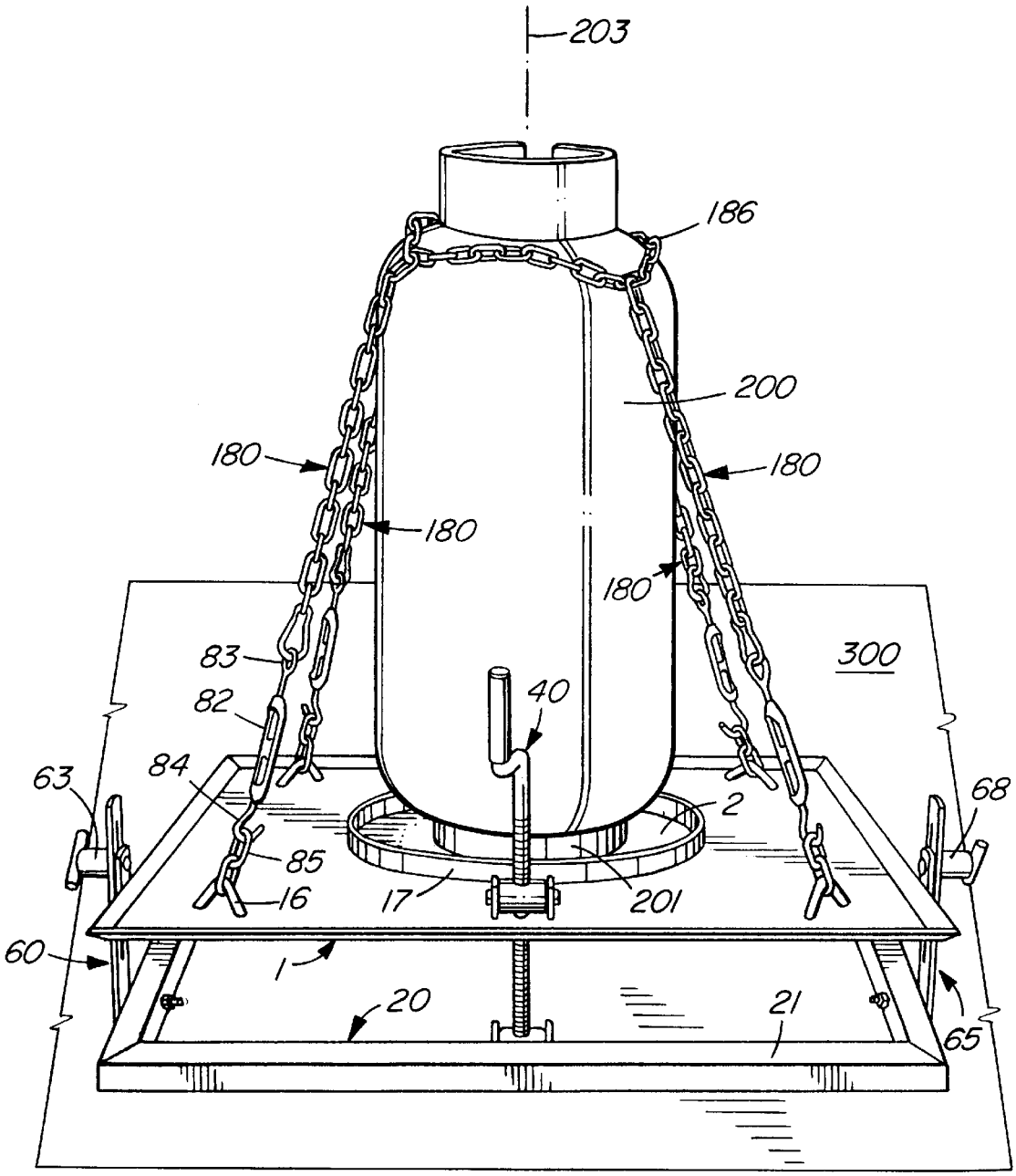
FIG. 5 illustrates the apparatus shown in FIG. 1 while carrying a relatively small propane tank in upright position on an inclined surface.

In FIGS. 4 and 5, the apparatus is rested on roof surface 300 simply under its own weight and the weight of the tank 100 or 200. The larger one of the tanks depicted (tank 100) weighed about 190 pounds when filled with propane fuel. Given the particular incline of the roof and the friction characteristics which prevailed between the framework and the roof surface, the installations depicted were found to be very stable without any tendency for the apparatus to slip downwardly on the surface. However, it is recognized that there may be an unacceptable risk of slippage in some situations if the angle of incline is greater or if the friction characteristics of the supporting surface are not suitable. In such cases, blocks (not shown) abutting side 21 of the framework may be installed on the surface to brace against any slip movement. Alternately, flanges (also not shown) or other suitable means connected to or associated with framework 20, and which serve to enable the framework itself to be bolted, pinned, or otherwise connected to the inclined surface, may be added to the framework.

Of course, the surface used to support the apparatus need not be a roof surface. Any surface on which framework 20 can achieve a suitable footing will suffice. This may be a roof surface, a ground surface, or otherwise. In the foregoing description, a roof surface has been indicated by way of illustration because this can be a convenient and expedient surface to use, particularly in the case of mobile building structures which require propane fuel and which may be moved from one temporary working site to another (as with construction camps, logging camps, etc.). The apparatus described is considered particularly suitable for such mobile applications not only because propane tanks can easily be installed and replaced once the apparatus is in position, but also because the apparatus itself is highly portable. When not in use, platform 1 can be pivoted towards framework 20 to form a relatively thin structure which is easy to store and transport. If desired, protruding elements such as crank 40 and bracing member 60, 65 can be easily removed.

While the basic purpose of the apparatus shown in the figures is to hold a tank such as tank 100 or tank 200 in an upright position when the apparatus is positioned on an inclined surface, it will be appreciated that the apparatus can usefully serve to hold a tank in an upright position when the apparatus is positioned on a horizontal surface. This is simply a special case where the slope of the inclined surface happens to be zero degrees.

It is to be understood that various modifications and changes can be made to the form, details, arrangement and proportion of the various parts described with reference to the foregoing embodiment without departing from the scope of the present invention. The invention is not to be construed as limited to the particular embodiment which has been described and should be understood as encompassing those embodiments which are within the spirit and scope of the claims which follow.

We claim:

1. Apparatus for holding an elongated tank in an upright position when the apparatus is positioned on an inclined surface, said tank having a bottom end, a top end, and a longitudinal axis extending between said ends, said apparatus comprising:

(a) base support means for providing a footing for said apparatus on said surface;

(b) a platform for carrying said tank while said bottom end of said tank is rested on said platform;

(c) means for securing said tank to said platform with the longitudinal axis of said tank extending substantially perpendicular to a plane of support associated with said platform, said securing means comprising:

(i) a collar removably positionable over and against said top end of said tank; and, (ii) a plurality of anchor lines, each of said anchor lines being securable at one end to said platform and, at an opposed end, to said collar when said collar is positioned as aforesaid;

(d) means for pivotally connecting said platform to said base support means for permitting pivotal movement of said platform relative to said base support means about a pivot axis extending parallel to said plane of support;

(e) means for pivoting said platform about said pivot axis between a position where said plane of support extends substantially parallel to said inclined surface and a position where said plane of support extends substantially horizontally; and, (f) means for bracing said platform in said horizontal position.

2. Apparatus as defined in claim 1, wherein each of said anchor lines includes a turnbuckle for tensioning the line.

3. Apparatus for holding an elongated tank in an upright position when the apparatus is positioned on an inclined surface, said tank having a bottom end, a top end, and a longitudinal axis extending between said ends, said apparatus comprising:

(a) a framework for providing a footing for said apparatus on said surface;

(b) a platform for carrying said tank while said bottom end of said tank is rested on said platform;

(c) means for securing said tank to said platform with the longitudinal axis of said tank extending substantially perpendicular to a plane of support associated with said platform;

(d) means for pivotally connecting a first side of said platform to a first side of said framework for permitting pivotal movement of said platform relative to said framework about a pivot axis extending parallel to said sides; and, (e) means for pivoting said platform about said pivot axis between a position where said plane of support extends substantially parallel to said inclined surface and a position where said plane of support extends substantially horizontally, said pivoting means comprising:

(i) a crank, said crank including a crank shaft threadingly engaged with said platform and a crank handle for rotating said shaft; and, (ii) a crank shaft support carried by said framework for rotatably holding a base end of said shaft, said shaft support permitting rotation of said base end in said shaft support during rotation of said shaft using said crank handle; and, (f) means for bracing said platform in said horizontal position.

4. Apparatus as defined in claim 3, wherein said bracing means comprises a bracing member extending from said framework to said platform for releasably holding said platform in said horizontal position.

5. Apparatus as defined in claim 3, wherein said bracing means comprises first and second bracing members extending from opposed sides of said framework to opposed sides of said platform for releasably holding said platform in said horizontal position.

* * * * *